US006448948B1

(12) United States Patent
Friedman

(10) Patent No.: US 6,448,948 B1
(45) **Date of Patent: *Sep. 10, 2002**

(54) DISPLAY COLUMN DRIVER WITH CHIP-TO-CHIP SETTLING TIME MATCHING MEANS

(75) Inventor: Jay Friedman, Felton, CA (US)

(73) Assignee: Candescent Intellectual Property Services, Inc., San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/490,556

(22) Filed: Jan. 25, 2000

Related U.S. Application Data

(63) Continuation of application No. 09/016,716, filed on Jan. 30, 1998, now Pat. No. 6,067,061.

(51) Int. Cl.[7] ..... G09G 3/22
(52) U.S. Cl. ..... 345/74; 345/75
(58) Field of Search ..... 345/74, 77, 75, 345/205; 313/422; 348/796

(56) References Cited

U.S. PATENT DOCUMENTS 6,040,809 A * 3/2000 Friedman ..... 345/74
6,067,061 A * 5/2000 Friedman ..... 345/74

* cited by examiner

*Primary Examiner*—Bipin Shalwala
*Assistant Examiner*—Nitin Patel
(74) *Attorney, Agent, or Firm*—Wagner Murabito & Hao LLP

(57) ABSTRACT

A device for and method of eliminating undesirable vertical segments of uneven brightness in flat panel field emission display (FED) screens. Within the FED screen, a matrix of rows and columns is provided and emitters are situated within each row-column intersection. Amplitude modulated signals are provided to the columns by column drivers and discrepancies in settling times among the column drivers cause vertical segments of uneven brightness on the display screen. The present invention normalizes settling time of the column amplifier that can be variant due to differences in semiconductor processing and manufacturing. The present invention includes specialized circuitry coupled to the column drivers for sensing an output of the column driver and determining a difference between the output and a threshold at a particular time before the output has completely settled to a target voltage. In response to the difference, amplifier bias voltage of output amplifiers within each column driver are altered in order to deviate the settling time of the column driver towards a target settling time. As a result, the settling times of all the column drivers in the FED screen are matched. Consequently, the brightness variation problem is eliminated.

12 Claims, 6 Drawing Sheets

DISPLAY COLUMN DRIVER WITH CHIP-TO-CHIP SETTLING TIME MATCHING MEANS

This is a continuation of copending application(s) Ser. No. 09/016,716 filed on Jan. 30, 1998 which is hereby incorporated by reference to this specification now U.S. Pat. No. 6,067,061.

FIELD OF THE INVENTION

The present invention relates to the field of flat panel display screens. More specifically, the present invention relates to the field of flat panel field emission displays (FEDs).

BACKGROUND OF THE INVENTION

Flat panel field emission displays (FEDs), like standard cathode ray tube (CRT) television sets, generate light by impinging high energy electrons on a picture element of a phosphor screen. The excited phosphor then converts the electron energy into visible light. However, unlike conventional television CRTs which use a single electron beam to scan across the phosphor screen in a raster pattern, FEDs use individual stationary electron sources for each pixel of the phosphor screen. Thus, a screen with a million color pixels has at least a million individual electron sources. There are three electron sources, each source consisting of many emitters, for each pixel in RGB color screen; one for red, one for green and one for blue. By using stationary electron sources instead of a scanning beam, the distance between the electron source and the phosphor screen can be made to be extremely small. Consequently, FED displays can be made to be very thin.

As mentioned, conventional CRT displays use electron beams to scan across the phosphor screen in a raster pattern. Specifically, the electron beams scan along a row in a horizontal direction and adjust the intensity according to the desired brightness of each picture element of that row. The electron beams then step in a column (vertical) direction and scan the next row until all the rows of the display screen are scanned. In marked contrast, in FEDs, a group of stationary electron sources are formed for each picture element (pixel) of the display screen. More specifically, the pixels of an FED flat panel screen are arranged in an array of horizontally aligned rows and vertically aligned columns. A portion 100 of this array is shown in FIG. 1A. The boundaries of a respective pixel 125 are indicated by dashed lines and in this configuration include a red point, a green point, and a blue point. Three separate row lines 130*a*–130*c* are shown. Each of the row lines 130*a*, 130*b*, and 130*c* is a row electrode for one of the rows of pixels in the array. A pixel row is comprised of all the pixels along one row line 130. Each column of pixels may include three columns lines 150: one for red, a second for green, and a third for blue. The column lines 150 control gate electrodes of the FED screen. When electron-emitting elements contained within the row electrode are suitably excited by adjusting the voltage of the corresponding row lines 130 (row electrodes) and column lines 150 (gate electrodes), electrons are emitted and are accelerated toward a phosphor anode 120. The excited phosphors at the anode 120 then emit light.

In order to realize different gray scale levels, different voltages are applied to the column lines 150. Brightness of the pixels depends on the voltage potential applied across the row electrode and the gate electrode. The larger the voltage potential, the brighter the pixel. In addition, brightness of the pixel depends on the amount of time the voltage potential is applied. The larger the amount of time a potential difference is applied, the brighter the pixel. In operation, all column lines 150 are driven with gray-scale data and simultaneously one row is activated. The gray-scale information causes the column drivers to assert different voltage amplitudes (amplitude modulation) to realize the different gray-scale contents of the pixel. This causes a row of pixels to illuminate with the proper gray scale data. This is then repeated for another row, etc., until the frame is filled.

During a screen frame refresh cycle (performed at a rate of approximately 60 Hz), one row is energized to illuminate one row of pixels for an "on-time" period. This is typically performed sequentially in time, row by row, until all pixel rows have been illuminated to display the frame. For each new row, the column data changes. Therefore, the column voltage must settle to a new voltage as each new row is asserted. For instance, if frames are presented at 60 Hz and the FED display has 480 rows in the display array, each row is energized every 34.8 $\mu$s. Consequently, an appropriate column voltage settling time is 10 $\mu$s. Since the columns are energized at a high rate, it is critical to ascertain that each column is energized at a near identical rate. Otherwise, if some columns have a slightly longer settling time than the others, the brightness across the screen will not be uniform which can cause unwanted screen artifacts such as vertical segments of different brightness.

Unfortunately, in prior art FED systems, it is difficult to eliminate such screen artifacts. The principal reason is attributed to manufacturing complications which cause column drivers to have different settling times. FIG. 1B illustrates this problem. As shown, the column driver 2 settles at a faster rate than column driver 3, but slower than column driver 1, causing the group of column lines driven by different column drivers to have disparate "on-time" windows. As a result, vertical segments of uneven brightness appear on the display. A means to cause the column drivers to settle to the same voltage at the same time eliminates this brightness variation problem. One prior art method of matching the settling times of the column drivers fabricates the column drivers from adjacent dies on the same wafer. This solution, however, is not practical because there is no guarantee that column drivers made from the same wafer have the same settling time. Further, if one column driver in a display malfunctions, the whole set of column drivers have to be replaced with others from the same wafer.

Accordingly, the present invention provides a mechanism and device for eliminating objectionable vertical segments of different brightness on an FED display. The present invention also provides a mechanism and device for normalizing the settling times of all the column drivers in a FED display. These and other advantages of the present invention not specifically mentioned above will become clear within discussions of the present invention presented herein.

SUMMARY OF THE INVENTION

A circuit and method are described herein for providing uniform display brightness by eliminating segments of uneven brightness in flat panel field emission display (FED) screen. Within the flat panel FED screen, a matrix of rows and columns is provided and electron emitters are situated within each row-column intersection. In one embodiment, rows are activated sequentially from the top most row down to the bottom row with only one row asserted at a time; and columns are driven to a new voltage level simultaneously as each row is asserted. When a proper voltage is applied across the row electrode and column electrodes, emitters release electrons toward a respective phosphor spot, causing an illumination point on the display.

According to one embodiment of the present invention, column lines of the FED screen are driven by column drivers. By measuring an output voltage of each column driver, the settling time of each column driver is then determined, and a signal representative of each settling time is generated. The signal is then used to deviate the settling time of the respective column driver towards a target settling time. As a result, the settling times of all the column drivers in the FED screen are normalized. Consequently, the brightness variation problem is eliminated.

In one embodiment of the present invention, the column drivers each comprises output amplifiers for forming output voltages for each column, and a dummy output amplifier for forming a dummy output voltage. Each column driver also comprises a phase-detector for comparing the dummy output voltage and a target reference signal, and for generating phase difference signal. The phase difference signal is then used to adjust bias current or bias voltage of output amplifiers within the column driver such that the settling time of the column driver is deviated towards the a target settling time. Each column driver may also include a filter/buffer circuit coupled to the phase detectors circuits for averaging the phase difference signal over a number of cycles. Further, dummy outputs of the column drivers may be coupled together to drive a common dummy load.

Specifically, embodiments of the present invention may include a field emission display screen comprising: a plurality of rows and columns; a plurality of row drivers coupled to the rows, a plurality of column drivers each having a plurality of output amplifiers and a dummy output amplifier; a plurality of phase detectors for comparing dummy outputs of the column drivers to a threshold voltage and a target time signal, and for generating a phase difference signal; and a plurality of loop filter/buffer circuits for supplying an amplifier bias voltage such that the settling times of the column drivers are normalized.

DETAILED DESCRIPTION OF THE PREFERRED EMBODIMENT

In the following detailed description of the present invention, a method and mechanism to provide uniform display brightness by eliminating objectionable bands of uneven brightness on an FED screen, numerous specific details are set forth in order to provide a thorough understanding of the present invention. However, it will be recognized by one skilled in the art that the present invention may be practiced without these specific details or with equivalents thereof. In other instances, well known methods, procedures, components, and circuits have not been described in detail as not to unnecessarily obscure aspects of the present invention.

In the following, the present invention is discussed in relation to flat panel field emission display (FED) systems. FED is an emerging technology, and specific embodiments of this technology are described in U.S. Pat. No. 5,541,473 issued on Jul. 30, 1996 to Duboc, Jr. et al.; U.S. Pat. No. 5,559,389 issued on Sep. 24, 1996 to Spindt et al.; U.S. Pat. No. 5,564,959 issued on Oct. 15, 1996 to Spindt et al.; and U.S. Pat. No. 5,578,899 issued Nov. 26, 1996 to Haven et al., which are incorporated herein by reference. However, it should be apparent to those skilled in the art, upon reading this disclosure, that the present invention and principles described herein may be applied to other types of display systems as well.

Figure 1A:
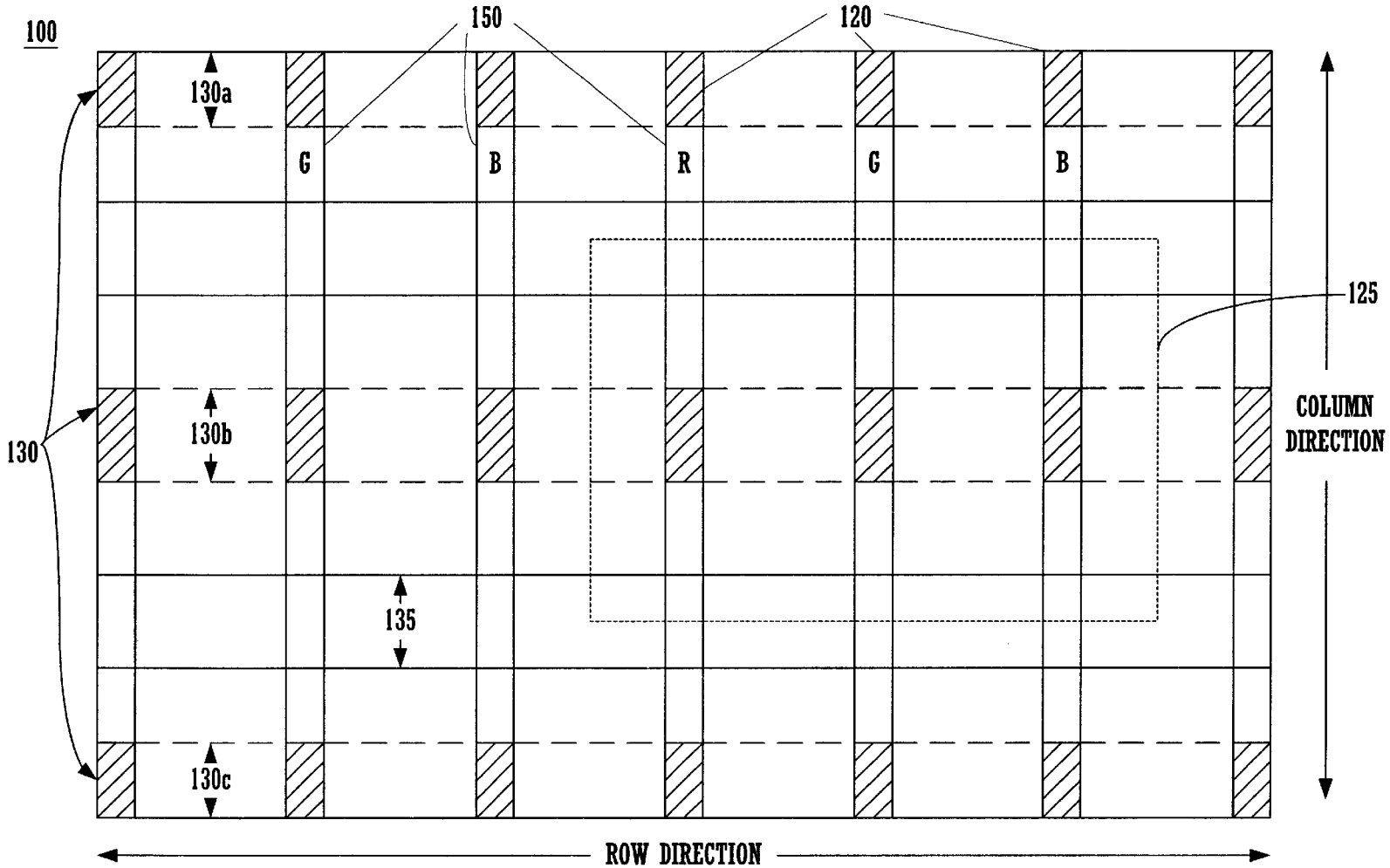
FIGURE 1A (Prior Art)
FIG. 1A is a plan view of internal portions of a flat panel FED and illustrates several intersecting rows and columns of the display.
Figure 1B:
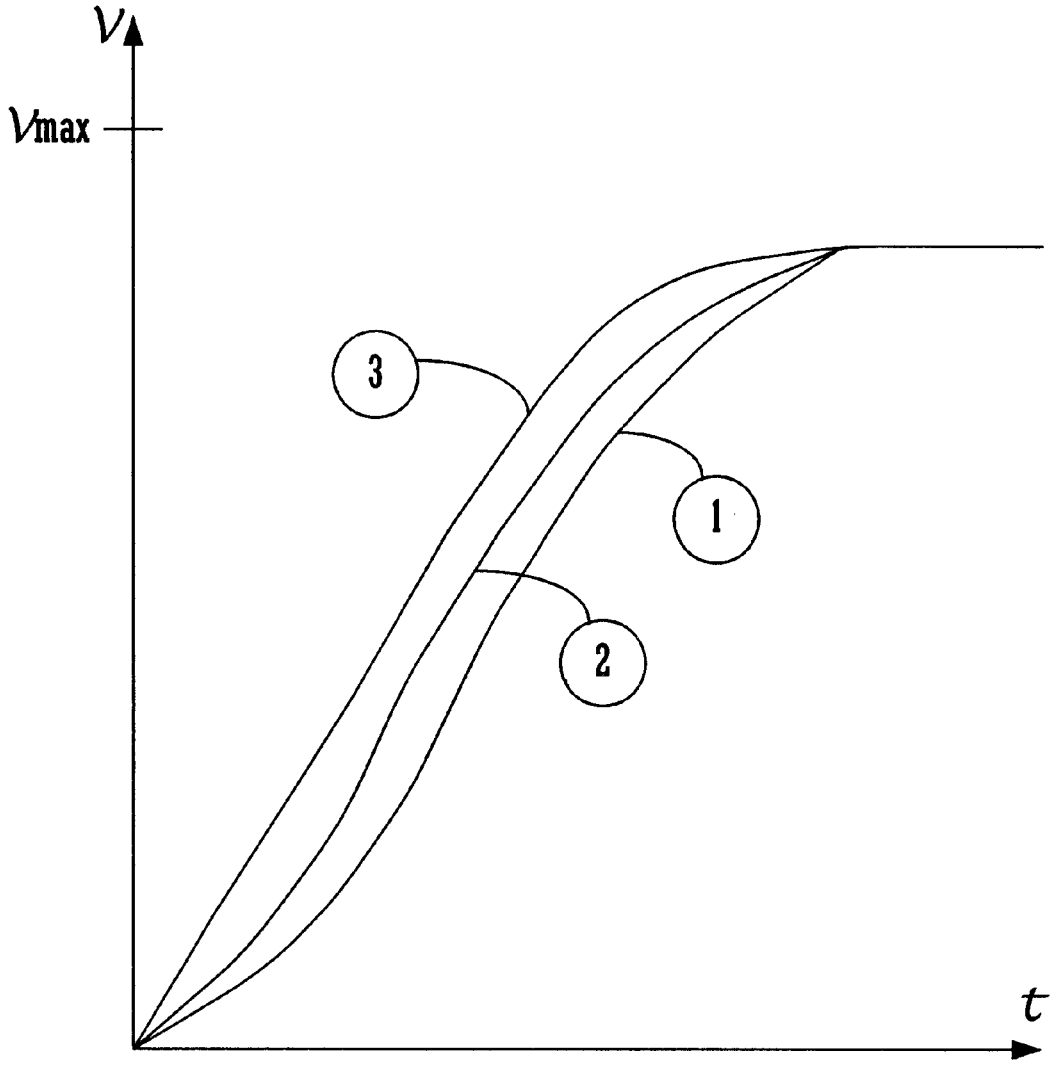
FIGURE 1B (Prior Art)
FIG. 1B is a graph showing the output voltages of three separate prior art column drivers as a function of time.
Figure 2:
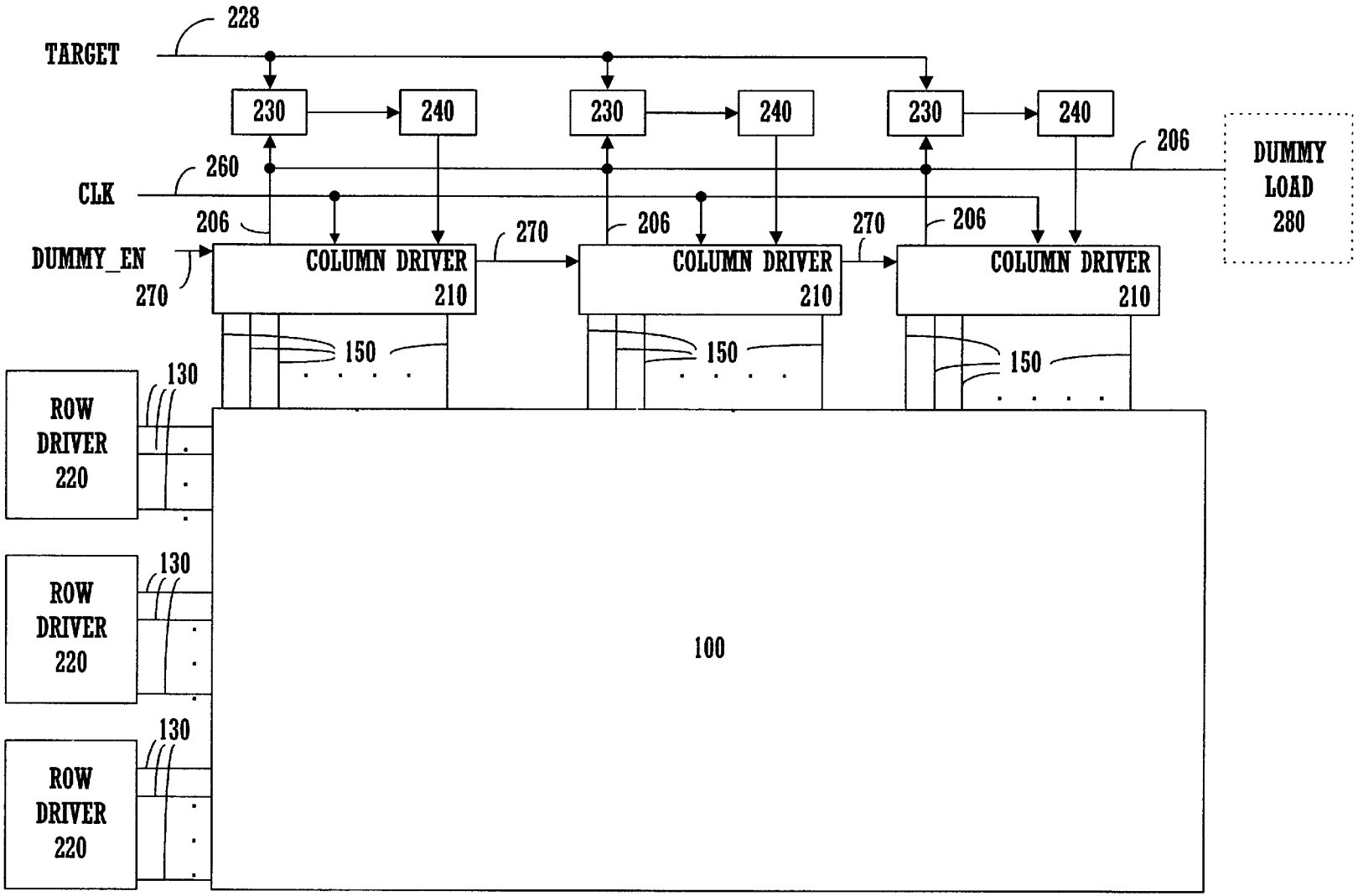
FIG. 2 illustrates a block diagram of the present invention including a flat panel FED screen, a plurality of column drivers and phase detectors.

FIG. 2 illustrates a block diagram of an FED system 200 in accordance with the present invention. As shown, the FED system 200 includes an FED screen 100 as shown in FIG. 1A, column drivers 210 for driving column lines 150, row drivers 220 for driving row lines 150, phase detection circuits 230 coupled to the column drivers 210, and filter/buffer circuits 240 coupled to the phase detection circuits 230 and the column drivers 210. For clarity, only three column drivers with their corresponding phase comparator circuits 230 and filter/buffer circuits 240 are shown in FIG. 2. However, it should be apparent to those of ordinary skill in the art, upon reading the present disclosure, that the number of column lines driven by each column driver 210 is arbitrary and that the present invention is well-suited for any number of column drivers 210. Further, in FIGS. 2 and 3, phase detection circuits 230 are shown to be external to the column drivers 210. However, it should also be apparent to a person of ordinary skill in the art, upon reading this disclosure, that each phase detection circuit 230 may be integrated with each column driver circuit on the same chip.

In the preferred embodiment, the column drivers 210 supply output voltages to the columns via column lines 150. In addition, upon receiving a row synchronization signal CLK via line 260, the output voltages are changed to a new value according to gray-scale information supplied to the column drivers 210. Further, each column driver 210 includes a dummy output line for providing a dummy voltage $V_{DUMMY}$ a common dummy load 280. The dummy load 280 is configured to have resistance and capacitance similar to a column in the FED screen 100. In this way, the dummy output voltage $V_{DUMMY}$ will more closely track the output voltages at the column lines 150. In an alternate embodiment, the dummy output line 206 may be coupled to drive an extra column of the FED screen 100 instead of a dummy load.

It is desirable for all the column drivers 210 to drive a common load such that errors caused by variations in the output load would not be introduced. However, in order to avoid bus contention, the column drivers 210 must be configured to drive the dummy load 280 one column driver 210 at a time. To that end, a dummy output enable signal (DUMMY_EN) is supplied to the column drivers 210 via data line 270 and is shifted through these column drivers 210 periodically during each frame update. Therefore, only one column driver 220 is selected to generate the dummy output signal at any one time. In the preferred embodiment, each column driver 210 is configured to generate dummy output voltages at a minimum rate of 30 Hz such that the FED screen 100 may achieve uniform brightness within one second by providing an average of 30 phase comparisons of dummy output crossing the threshold to the target time.

The exact time when the dummy voltage is provided within the frame cycle, however, is arbitrary. For instance, one column driver may provide the dummy voltage when the fifth row is asserted, and another column driver may drive the dummy load 280 when the one-hundredth row is asserted. In the preferred embodiment, the column drivers 210 are activated once every two frame cycles such that each column driver 210 generates $V_{DUMMY}$ at a rate of 30 Hz. Circuits and mechanisms for producing the dummy-enable signal DUMMY_EN, such as a clock subdivision circuit, are well known in the art and are not presented here so as to avoid obscuring aspects of the present invention.

The dummy output line 206 is coupled to provide $V_{DUMMY}$ to the phase detection circuit 230. The phase detection circuit 230 measures a time difference between the time $V_{DUMMY}$ reaches a threshold voltage and a target settling time. Depending on the time difference, the phase detection circuit 230 produces a phase signal $V_{PHASE}$, which is then averaged over a number of frame cycles by filter/buffer circuit 240 to produce an amplifier bias voltage $V_{BIAS}$. In one embodiment, the target settling time is supplied by controller logic circuits (not shown) via line 228.

Each column driver 210 also comprises an amplifier bias input line 208. The amplifier bias input 208 is coupled to receive the amplifier bias voltage $V_{BIAS}$ from the filter/buffer circuit 240. The amplifier bias voltage $V_{BIAS}$, which is supplied by the filter/buffer circuit 240, biases output amplifiers in the respective column driver 210, and thereby increases or decreases the rate the column driver 210 reaches a target voltage. The amplifier output biasing mechanism is common in operational transconductance amplifiers and operational amplifiers, and are therefore not described here in detail so as to avoid obscuring aspects of the present invention. In one embodiment, the dummy voltage is driven from $V_{MIN}$ to $V_{MAX}$, $V_{MIN}$ corresponds to a minimum brightness for the display and is typically 0 V. $V_{MAX}$ corresponds to maximum brightness for the display and is typically +10 V. Naturally, other voltages may also be applied. Although the columns may not be driven to $V_{MAX}$ all the time, the settling times to all other voltages would also be substantially matched when the settling time to $V_{MAX}$ is matched.

Figure 3:
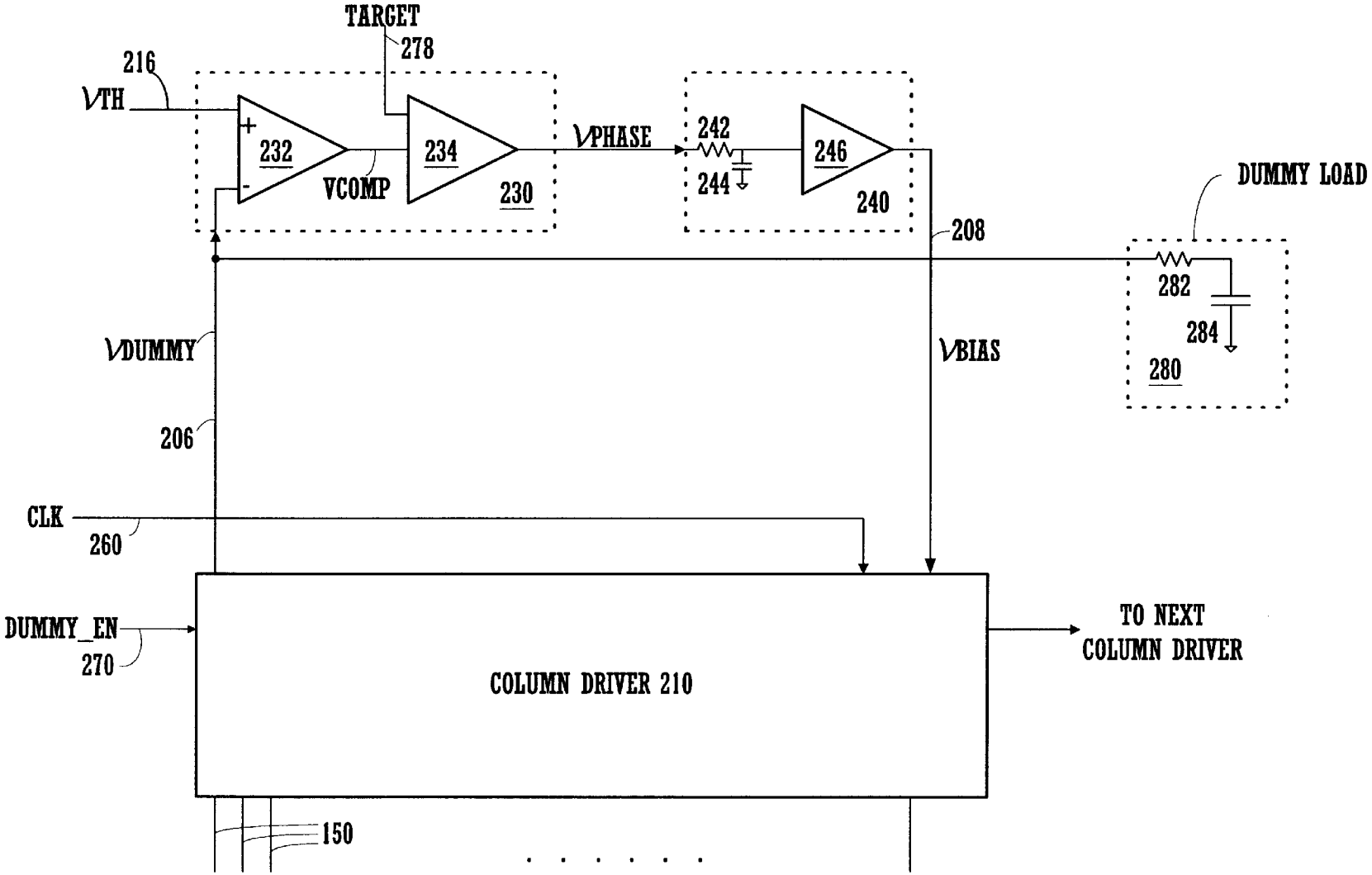
FIG. 3 illustrates a schematic of the phase detectors coupled to column drivers of the present invention.
Figures 4A, 4B, 4C, 4D:
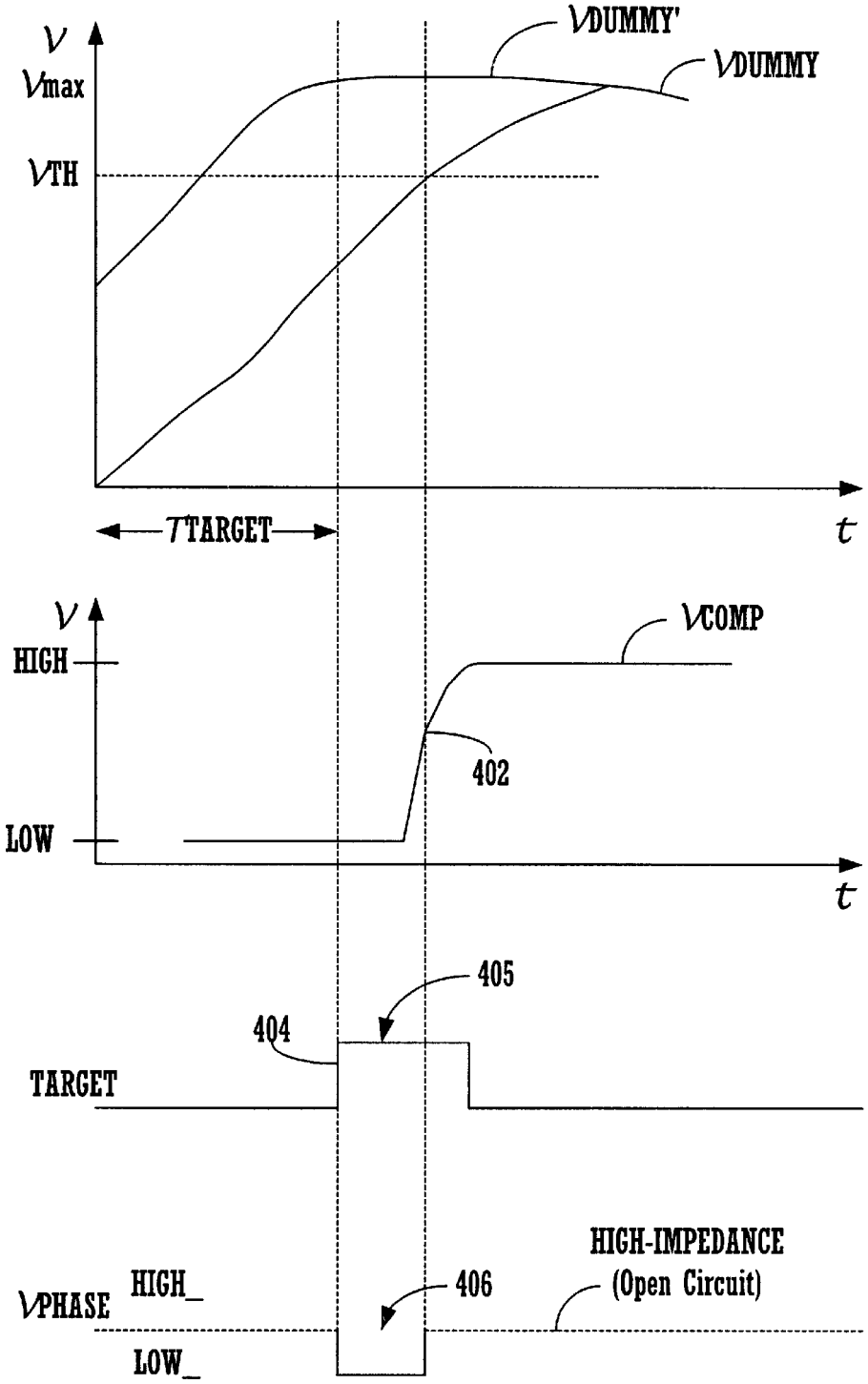
FIGS. 4A, 4B, 4C, 4D, and 4E illustrate timing diagrams for signals $V_{DUMMY}$, $V_{COMP}$, TARGET, a positive $V_{PHASE}$ pulse, and a negative $V_{PHASE}$ pulse for a column driver of the present invention.

FIG. 3 illustrates a schematic of the phase detection circuit 230 and the filter/buffer circuit 240. In the preferred embodiment, the phase detection circuit 230 comprises a comparator 232 and a phase detector 234. A negative input of the comparator 232 is coupled to the dummy output line 206 to receive $V_{DUMMY}$, and a positive input is coupled to a line 216 for receiving a threshold voltage $V_{TH}$. The comparator 232 compares $V_{DUMMY}$ to $V_{TH}$, and produces an output voltage $V_{COMP}$. In the preferred embodiment, the maximum column voltage $V_{MAX}$ is +10.0 V, and $V_{TH}$is set at 99% of the maximum column voltage. Thus, as illustrated in FIGS. 4A and 4B, when $V_{DUMMY}$ changes from $V_{MIN}$ to $V_{MAX}$, the output $V_{COMP}$ of the comparator 232 changes sharply from a logic low voltage to a logic high voltage when $V_{DUMMY}$ across $V_{TH}$. As a result, a sharp rising edge 402 (FIG. 4B) is generated.

Figure 4E:
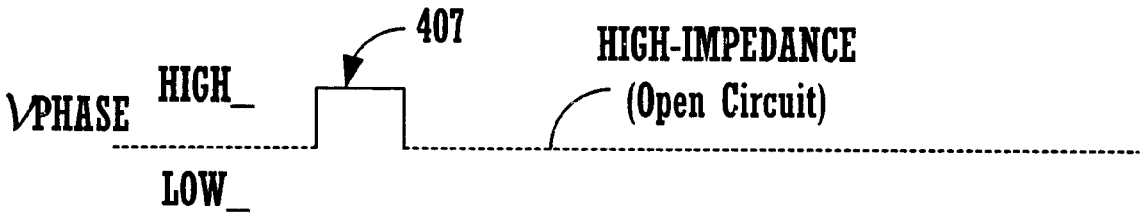

The output of the comparator 232 is coupled to provide $V_{COMP}$ to a first input of a phase detector 234. A second input of the phase detector 234 is coupled to receive a TARGET signal from line 228. The phase detector 234 is sensitive to the relative timing of edges between the two input signals. Upon encountering a rising edge 404 of a TARGET pulse 405 (FIG. 4C) before the rising edge 402 of $V_{COMP}$ (phase lag), the phase detector 234 will be activated to produce a pulse 406 having a negative polarity (FIG. 4D). However, if the phase detector 234 detects a phase lead, a pulse having a positive polarity will be produced (FIG. 4E). Thus, depending on whether the transition of the $V_{COMP}$ occurs before or after the transition of the reference signal TARGET, the phase comparator 234 generates either negative or positive $V_{PHASE}$ pulses, respectively. The polarity and width of these $V_{PHASE}$ pulses is representative of the phase difference between the respective edges. The output circuitry (not shown) of the phase detector 234 either sinks or sources current (respectively) between the $V_{PHASE}$ pulse and the target pulse, and is otherwise open-circuited, generating an average output voltage over multiple cycles. In one embodiment, the phase detector 228 is a common CMOS digital integrated circuit 4046 available from many IC manufacturers.

In operation, during each frame cycle, each the column driver 210 generates dummy output voltage $V_{DUMMY}$, which is compared to threshold voltage $V_{TH}$ by the comparator 232 to produce comparator output voltage $V_{COMP}$. As $V_{DUMMY}$ changes from $V_{MIN}$ to $V_{MAX}$ across $V_{TH}$, rising edge 402 in $V_{COMP}$ will be generated. The comparator output $V_{COMP}$ is coupled to phase detector 234, which detects whether the rising edge 402 occurs before or after rising edge 404 of TARGET pulse 405. For instance, if the rising edge 402 lags behind the rising edge 404, $V_{PHASE}$ pulse 406 having a negative polarity will be generated. If the rising edge 402 leads the rising edge 404, $V_{PHASE}$ pulse 407 having a positive polarity will be generated. The $V_{PHASE}$ pulses generated by each phase detector 234 are filtered and buffered to produce a voltage $V_{BIAS}$ representative of the phase lead or lag over a number of preceding frames. The voltage $V_{BIAS}$ is fed back to the respective column driver 210 and biases output amplifiers of the column driver 210. As $V_{BIAS}$ goes more negative, the outputs of the column driver 210 settles faster. As the amplifier bias voltage $V_{BIAS}$ is dynamically adjusted to cause $V_{DUMMY}$ to cross $V_{TH}$ at the target settling time, the settling times of the column drivers 210 will be normalized. Thus, objectionable bands of uneven brightness of the FED display will be eliminated.

FIG. 3 also illustrates a loop filter/buffer circuit 240 including a resistor 242 coupled to a capacitor 244 and to an input of a buffer 246. The loop-filter/buffer circuit 240 averages the output pulses of the phase detector 234, and produces the amplifier bias voltage $V_{BIAS}$ which provides appropriate voltage or sets an appropriate current for biasing output amplifiers of the column drivers 210 so that the desired settling time occurs. The output of the filter/buffer circuit 240, $V_{BIAS}$, varies according to the polarity and pulse-width of the output pulses $V_{PHASE}$. For instance, if the column driver 210 is slow and lags behind TARGET by a large margin, the width of the output pulses $V_{PHASE}$ will be large, the resulting $V_{BIAS}$ will be more negative. In the preferred embodiment, the output amplifiers within the column drivers 210 are configured to settle at a faster rate in response to a more negative gate voltage $V_{BIAS}$. Consequently, settling process at the column drivers 210 is accelerated.

FIGS. 4A–E illustrate timing diagrams and phase diagrams of the operations of the respective column driver 210 in accordance with the present invention. FIG. 4A illustrates a dummy output voltage $V_{DUMMY}$ produced by an active column driver 210. As shown, as $V_{DUMMY}$ rises from $V_{MIN}$ to $V_{MAX}$, it crosses $V_{TH}$. However, $V_{DUMMY}$ does not cross $V_{TH}$ at a target settling time $\tau_{TARGET}$. FIG. 4A also illustrates, in broken lines, $V_{DUMMY}$, of a column driver 210 that crosses $V_{TH}$ earlier than the target time $\tau_{TARGET}$. FIG. 4B illustrates the output $V_{COMP}$ of comparator 232. As shown, a sharp rising edge 402 occurs when $V_{DUMMY}$ rises from $V_{MIN}$ to $V_{MAX}$ across $V_{TH}$. The comparator output voltage $V_{COMP}$ is compared to TARGET by phase detector 234.

FIG. 4C illustrates a pulse 405 of the target time signal TARGET having a rising edge 404 at target settling time $\tau_{TARGET}$. Preferably, TARGET is generated by logic control circuitry (not shown) external to the column drivers 210. TARGET is synchronized with DUMMY_EN (FIGS. 2 and 3). The target time signal TARGET occurs once per column driver per frame update such that the dummy load 280 (FIGS. 2 and 3) is driven by the column drivers 210 one at a time. Only one pulse 405 of the target time signal TARGET is shown in FIG. 4C for clarity.

According to the preferred embodiment, the phase detector 234 is edge-triggered to generate $V_{PHASE}$ pulses. Essentially, the polarity and width of the $V_{PHASE}$ pulse 406 is determined by how early or late $V_{DUMMY}$ reaches $V_{TH}$ with respect to TARGET. As shown in FIG. 4D, output of phase detector 234, which is in a high-impedance state before the rising edge 404, is pulled down to a logic low voltage upon detecting the rising edge 404. The output of phase detector 234 remains in a logic low voltage until the phase detector 234 is deactivated by the rising edge 402, and the output returns to a high-impedance state. FIG. 4E illustrates a positive $V_{PHASE}$ pulse, which is generated when the $V_{DUMMY}$, crosses $V_{TH}$ before the rising edge 404 of the target time signal TARGET. Notably, the rising edge of the positive $V_{PHASE}$ pulse occurs when $V_{DUMMY}$, crosses $V_{TH}$.

A method of and device for eliminating objectionable segments of uneven brightness on an FED screen has thus been disclosed. By measuring the output voltage of the column driver, the settling speed of the column driver is determined, and a signal representative of the settling speed is generated. The signal is then used to adjust the settling speed of the column driver by altering gate voltages of transistors in the output amplifiers of the column drivers. As a result, the settling times of all the column drivers in the FED screen are matched. Consequently, the brightness variation problem is eliminated.

What is claimed is:

1. A field emission display comprising:

a plurality of rows;

a first plurality of columns;

a plurality of row drivers coupled to activate and deactivate said plurality of rows;

a first column driver coupled to provide modulated signals to said first plurality of said columns wherein said first column driver has a first settling time;

a first phase detector coupled to said first column driver for comparing said first settling time to a predetermined settling time and for providing to said first column driver a first phase signal representative of time difference between said first settling time and said predetermined settling time, wherein said first column driver adjusts said first settling time to match said predetermined settling time in response to said first phase signal.

2. A field emission display according to claim 1 wherein said first column driver further comprises:

a first output amplifier for providing modulated signals to said first plurality of columns; and a first dummy output amplifier for providing a dummy voltage to said first phase detector.

3. A field emission display according to claim 2 further comprising:

a second plurality of columns;

a second column driver coupled to provide modulated signals to said second plurality of columns wherein said second column driver has a second settling time; and a second phase detector coupled to said second column driver for comparing said second settling time to said predetermined settling time and for providing to said second column driver a second phase signal representative of time difference between said second settling time and said predetermined settling time, wherein said second column driver adjusts said second settling time to match said predetermined settling time in response to said first phase signal.

4. A field emission display according to claim 3 wherein said second column driver further comprises:

a second output amplifier for providing modulated signals to said second plurality of columns; and a second dummy output amplifier for providing a dummy voltage to said second phase detector.

5. A field emission display according to claim 4 further comprising a dummy load coupled to said first column driver and said second column driver, wherein said first dummy output amplifier is configured for driving by said first dummy output amplifier when said first dummy output amplifier is enabled and further wherein said dummy load is configured to be driven by said second dummy output amplifier when said second column driver is enabled.

6. Electronic circuitry for driving a field emission display that has a plurality of columns comprising:

a column driver for driving said plurality of columns wherein said column driver further comprises:

a plurality of output amplifiers coupled to provide modulated signals to said plurality of columns;

a dummy output amplifier for producing a dummy voltage output of said column driver wherein said dummy voltage output has a settling time;

an input for receiving an amplifier bias voltage representative of a phase difference between said settling time and a pre-determined target settling time;

circuit means for adjusting said settling time according to said amplifier bias voltage such that said settling time matches said predetermined target settling time.

7. Electronic circuitry as recited in claim 6 further comprising a phase detection circuit for generating said amplifier bias voltage.

8. Electronic circuitry as recited in claim 7 wherein said phase detection circuit further comprises:

a comparator for comparing said dummy voltage output to a threshold voltage, wherein a voltage transition signal is produced as said dummy voltage output changes from a first voltage to a second voltage and crosses said threshold voltage; and a phase signal generation circuit for generating a phase signal representative of a time difference between said voltage transition signal and a reference signal.

9. Electronic circuitry as recited in claim 8 wherein said phase signal has a negative polarity when said voltage transition signal lags behind said reference signal, and wherein said phase signal has a positive polarity when said voltage transition signal leads said reference signal.

10. Electronic circuitry as recited in claim 9 further comprising a low-pass filter coupled to said phase signal generation circuit for receiving said phase signal wherein said low-pass filter averages said phase signal over a number of frame cycles to produce said amplifier bias voltage.

11. Electronic circuitry as recited in claim 6 further comprising a dummy load capacitor coupled to be driven by said dummy output.

12. A column driver for driving a field emission display comprising:

a plurality of output amplifiers coupled to provide modulated signals to said plurality of columns;

a dummy output amplifier for producing a dummy voltage output of said column driver wherein said dummy voltage output has a settling time;

an input for receiving an amplifier bias voltage representative of a phase difference between said settling time and a pre-determined target settling time; and circuit means for adjusting said settling time according to said amplifier bias voltage such that said settling time matches said predetermined target settling time.

* * * * *